US010564565B1

(12) United States Patent
Kuribayashi et al.

(10) Patent No.: US 10,564,565 B1
(45) Date of Patent: Feb. 18, 2020

(54) ELECTROPHOTOGRAPHIC IMAGE FORMING APPARATUS

(71) Applicant: FUJI XEROX CO., LTD., Tokyo (JP)

(72) Inventors: Masataka Kuribayashi, Kanagawa (JP); Takafumi Koide, Kanagawa (JP); Katsuyuki Kitajima, Kanagawa (JP); Teppei Yawada, Kanagawa (JP); Shota Oshima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/371,132

(22) Filed: Apr. 1, 2019

(30) Foreign Application Priority Data

Aug. 27, 2018 (JP) ..... 2018-158613

(51) Int. Cl.

| | |
|---|---|
| ***G03G 15/20*** | (2006.01) |
| ***G03G 15/05*** | (2006.01) |
| ***G03G 15/08*** | (2006.01) |
| ***G03G 15/02*** | (2006.01) |
| ***G03G 15/00*** | (2006.01) |

(52) U.S. Cl.
CPC ..... *G03G 15/051* (2013.01); *G03G 15/0266* (2013.01); *G03G 15/0806* (2013.01); *G03G 15/2028* (2013.01); *G03G 15/6573* (2013.01)

(58) Field of Classification Search
CPC ..... G03G 15/0806; G03G 15/2028; G03G 15/6573; G03G 9/08782; G03G 9/08795; G03G 15/051; G03G 15/0266
See application file for complete search history.

(56) References Cited

U.S. PATENT DOCUMENTS

| | | | | |
|---|---|---|---|---|
| 2015/0185669 | A1* | 7/2015 | Nishinoue | G03G 15/6573 399/67 |
| 2016/0334749 | A1* | 11/2016 | Iwasaki | G03G 15/6573 |
| 2018/0024462 | A1 | 1/2018 | Shimada et al. | |
| 2018/0032011 | A1* | 2/2018 | Nanjo | G03G 15/2064 |
| 2018/0217532 | A1* | 8/2018 | Kikuchi | G03G 15/2025 |
| 2018/0275575 | A1* | 9/2018 | Uchida | G03G 9/08782 |

FOREIGN PATENT DOCUMENTS

| | | |
|---|---|---|
| JP | 2015138248 | 7/2015 |
| JP | 2017015802 | 1/2017 |
| JP | 2018022130 | 2/2018 |

* cited by examiner

*Primary Examiner* — Sophia S Chen
(74) *Attorney, Agent, or Firm* — JCIPRNET

(57) ABSTRACT

An image forming apparatus includes an image holding member, a charging unit that charges the surface of the image holding member, an electrostatic latent image forming unit that forms an electrostatic latent image on the charged surface of the image holding member, a developing unit that develops the electrostatic latent image to form a toner image, a transferring unit that transfers the toner image to a first side of a recording medium, a fixing unit that allows the recording medium having the transferred toner image to pass through a nipping region to fix the toner image, a first charging unit that faces the first side of the recording medium and that charges particles, and a second charging unit that charges a second side of the recording medium to the opposite polarity to the charged particles after the recording medium passes through the nipping region.

18 Claims, 3 Drawing Sheets

ELECTROPHOTOGRAPHIC IMAGE FORMING APPARATUS

CROSS-REFERENCE TO RELATED APPLICATIONS

This application is based on and claims priority under 35 USC 119 from Japanese Patent Application No. 2018-158613 filed Aug. 27, 2018.

BACKGROUND

(i) Technical Field

The present disclosure relates to an image forming apparatus.

(ii) Related Art

An electrophotographic process for forming an image, for example, includes charging the surface of an image holding member, forming an electrostatic latent image on this surface of the image holding member on the basis of image information, developing the electrostatic latent image with a developer containing toner to form a toner image, and transferring and fixing the toner image to the surface of a recording medium.

Japanese Laid Opened Patent Application Publication No. 2017-15802 discloses an image forming apparatus including an exhaust channel that introduces air discharged from a fixing device to the outside, the fixing device heating toner transferred to a sheet to fix the toner to the sheet; a charging unit that is disposed in the exhaust channel to charge ultra-fine particles in air to a first polarity; a collection unit that is disposed downstream of the charging unit in the direction of the airstream in the exhaust channel and that is charged to a second polarity which is opposite to the first polarity; and a controller that adjusts the absolute value of at least one of the charging voltages of the charging unit and collection unit to be greater in a predetermined first term from the beginning of the operation of the fixing device than in a predetermined second term which is after the first term.

Japanese Laid Opened Patent Application Publication No. 2015-138248 discloses an image forming apparatus including a fixing device that heats toner transferred to a sheet to fix the toner to the sheet, an exhaust mechanism that includes a first channel and second channel which split the stream of air discharged from the fixing device and then join the split airstreams, a first charging unit that changes ultra-fine particles passing through the first channel to a positive polarity, and a second charging unit that changes ultra-fine particles passing through the second channel to a negative polarity.

Japanese Laid Opened Patent Application Publication No. 2018-22130 discloses an image forming apparatus including a positive ion generator that generates positive ions which are to be discharged to an exhausted channel which guides air inside the image forming apparatus to the outside and a negative ion generator that generates negative ions which are to be discharged to the exhaust channel, wherein the positions of the positive ion generator and negative ion generator are different from each other in the direction of the airstream in the exhaust channel.

An image forming apparatus having a structure that enables fixing at low temperature, for example, includes a fixing unit which includes two rotational members having outer surfaces being opposite to and in contact with each other to form a nipping region and in which a recording medium having a transferred toner image is heated and pressed by passing through the nipping region to fix the toner image to the recording medium; in such an image forming apparatus, a toner having toner particles containing a release agent with a low melting temperature (such as a melting temperature of 100° C. or less) is used. The fixing unit is a so-called two-roll fixing unit in some cases in which the two rotational members are paired rollers.

In such an image forming apparatus, however, the two-roll fixing unit, for example, uses rollers having a high heat capacity and is therefore less likely to transfer heat to the recording medium; hence, temperature is high even downstream of the nipping region in the transport direction of the recording medium, and thus the release agent having a low melting temperature is easily evaporated in such a region. The evaporated release agent re-solidifies in air inside the apparatus, which may result in the generation of particles having a diameter of 100 nm or less [namely, Ultra-Fine Particles (UFPs)]. These particles having a diameter of 100 nm or less (UFPs) are discharged to the outside of the image forming apparatus in some cases.

SUMMARY

Aspects of non-limiting embodiments of the present disclosure relate to provide an image forming apparatus that includes a fixing unit having the above-mentioned structure and that involves use of a toner having toner particles containing a release agent with a melting temperature ranging from 60° C. to 100° C., and this image forming apparatus enables a reduction in the amount of particles having a diameter of 100 nm or less (UFPs) and discharged to the outside of the apparatus as compared with an image forming apparatus that does not have a first charging unit for charging particles and a second charging unit for charging a recording medium to the opposite polarity to the charged particles in the vicinity of the nipping region between the two rotational members and downstream of the nipping region in the transport direction of the recording medium.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding member, a charging unit that charges the surface of the image holding member, an electrostatic latent image forming unit that forms an electrostatic latent image on the charged surface of the image holding member, a developing unit that includes a developer containing toner particles containing a release agent having a melting temperature ranging from 60° C. to 100° C. and that develops the electrostatic latent image on the surface of the image holding member with the developer to form a toner image, a transferring unit that transfers the toner image to a first side of a recording medium, a fixing unit that includes two members of which the outer surfaces are in contact with each other to form a nipping region and that allows the recording medium having the transferred toner image to pass through the nipping region to fix the toner image to the first side of the recording medium, a first charging unit that is disposed in the vicinity of the nipping region and downstream of the nipping region in the transport direction of the recording medium so as to face the first side of the recording medium and that charges particles, and a second charging unit that charges a second side of the recording medium to the opposite polarity to the charged particles after the recording medium passes through the nipping region.

BRIEF DESCRIPTION OF THE DRAWINGS

Exemplary embodiment of the present disclosure will be described in detail based on the following figures, wherein.

DETAILED DESCRIPTION

Figure 1:
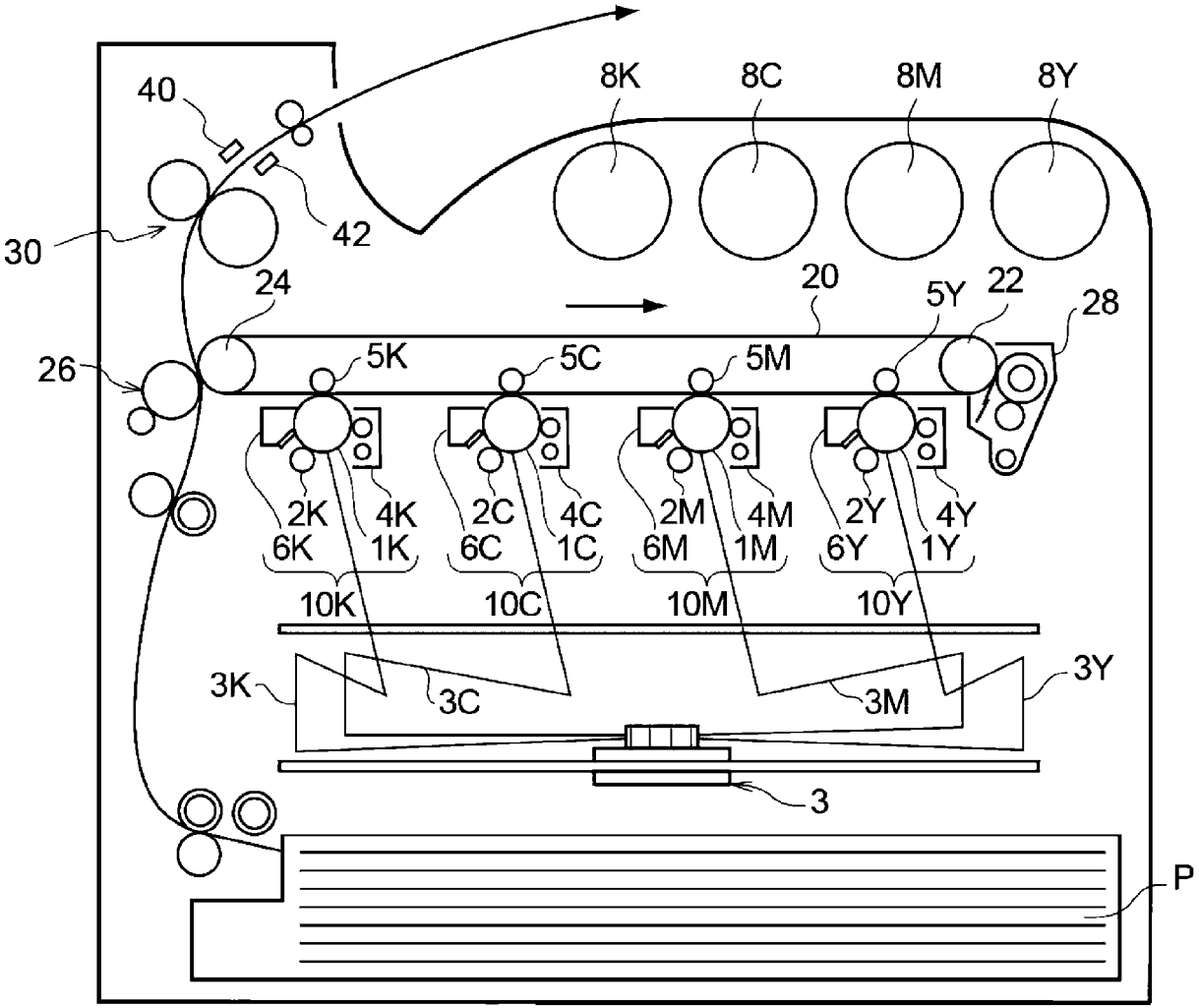
FIG. 1 schematically illustrates an example of the structure of an image forming apparatus according to the exemplary embodiment.

An exemplary embodiment that is an example of the present disclosure will now be described in detail.

Image Forming Apparatus

An image forming apparatus according to the exemplary embodiment includes an image holding member, an image holding member charging unit that charges the surface of the image holding member, an electrostatic latent image forming unit that forms an electrostatic latent image on the charged surface of the image holding member, a developing unit that includes a developer containing toner having toner particles containing a release with a melting temperature ranging from 60° C. to 100° C. and that develops the electrostatic latent image on the surface of the image holding member with the developer to form a toner image, a transfer unit that transfers the toner image to a first side of a recording medium, a fixing unit that includes two rotational members of which the outer surfaces are opposite to and in contact with each other to form a nipping region and that allows the recording medium having the transferred toner image to pass through the nipping region to fix the toner image to the first side of the recording medium, a first charging unit that is disposed in the vicinity of the nipping region and downstream of the nipping region in the transport direction of the recording medium so as to face the first side of the recording medium and that charges particles, and a second charging unit that charges a second side of the recording medium that is opposite to the first side to the opposite polarity to the charged particles after the recording medium passes through the nipping region.

The toner having toner particles containing a release agent with a melting temperature ranging from 60° C. to 100° C. is also referred to as "specific toner" in the following description.

Energy conservation has been demanded in recent years, and a technique for fixing toner at low temperature is therefore used to reduce power consumption in fixing of a toner image.

In order to enhance fixability at low temperature, for example, toner having toner particles containing a release agent having a low melting temperature (such as a release agent having a melting temperature of 100° C. or less) is used in a developer accommodated in a developing unit of some image forming apparatuses. In the case where an image is formed with such a toner containing a release agent having a low melting temperature and where a toner image transferred to a recording medium is fixed with a fixing unit, the release agent contained in the toner image is likely to be vaporized together with moisture contained in the recording medium. The vaporized release agent re-solidifies in air, which results in the generation of particles derived from the evaporated release agent and having a size of 100 nm or less [also referred to as Ultra-Fine Particles (UFPs)]. Such generated particles are discharged to the outside of the image forming apparatus in some cases.

In an image forming apparatus in which an image is fixed with a two-roller fixing unit, the rollers of the fixing unit have a high heat capacity, and heat is therefore less likely to be transferred to a recording medium; hence, the temperature tends to be high even downstream of the nipping region in the transport direction of the recording medium. Accordingly, the release agent having a low melting temperature is likely to be vaporized downstream of the nipping region of the fixing unit in the transport direction of the recording medium, and thus UFPs derived from the vaporized release agent tend to be easily generated.

The image forming apparatus according to the exemplary embodiment includes the fixing unit including two rotational members of which the outer surfaces are opposite to and in contact with each other to form the nipping region; in addition, the image forming apparatus also includes the first charging unit that is disposed in the vicinity of the nipping region and downstream of the nipping region in the transport direction of the recording medium so as to face the first side of the recording medium (namely, toner-image-fixed side) and that charges particles and a second charging unit that charges the second side of the recording medium, which is opposite to the first side, to the opposite polarity to the charged particles after the recording medium passes through the nipping region.

Since the first charging unit is disposed at a position at which UFPs are likely to be generated, the UPFs derived from the vaporized release agent are charged. Then, the second charging unit charges the second side of the recording medium having a fixed image, which is opposite to the toner-image-fixed side (namely, first side), to the opposite polarity to the charged particles (UFPs). The UFPs charged by the first charging unit are attracted by the recording medium charged to the opposite polarity and stick thereto.

As a result, the UFPs derived from the release agent are discharged to the outside of the apparatus in a state in which they are sticking to the recording medium, in other words not in the form of particles, which enables a reduction in the amount of the UFPs discharged to the outside of the apparatus.

The image forming apparatus having such a structure according to the exemplary embodiment may reduce the amount of the UFPs discharged to the outside of the apparatus, which may bring another benefit that a high-performance filter does not need to be used in an exhaust outlet.

The image forming apparatus according to the exemplary embodiment may be any of the following known image forming apparatuses: a direct transfer type apparatus in which the toner image formed on the surface of the image holding member is directly transferred to a recording medium, an intermediate transfer type apparatus in which the toner image formed on the surface of the image holding member is transferred to the surface of an intermediate transfer body and in which the toner image transferred to the surface of the intermediate transfer body is then transferred to the surface of a recording medium, an apparatus which has a cleaning unit that serves to clean the surface of the image holding member after the transfer of a toner image and before the charging, and an apparatus which has an erasing unit that radiates light to the surface of the image holding member to remove charges after the transfer of the toner image and before charging.

In the intermediate transfer type apparatus, the transfer unit, for example, includes an intermediate transfer body of which a toner image is to be transferred to the surface, a first transfer member which transfers a toner image formed on the surface of the image holding member to the surface of the intermediate transfer body, and a second transfer member which transfers the toner image transferred to the surface of the intermediate transfer body to the surface of a recording medium.

In the structure of the image forming apparatus according to the exemplary embodiment, for instance, the part that at least includes the image holding member may be in the form of a cartridge that is removably attached to the image forming apparatus (process cartridge).

An example of the image forming apparatus according to the exemplary embodiment will now be described, but the image forming apparatus according to the exemplary embodiment is not limited thereto. Only the parts illustrated in the drawings will be described, and description of the other parts is omitted.

FIG. 1 schematically illustrates the structure of the image forming apparatus according to the exemplary embodiment.

The image forming apparatus illustrated in FIG. 1 includes first to fourth electrophotographic image forming units 10Y, 10M, 10C and 10K (image forming units) that output yellow (Y), magenta (M), cyan (C) and black (K) color images, respectively, on the basis of image data separately corresponding to these colors. These image forming units (also simply referred to as "units) 10Y, 10M, 10C and 10K are horizontally disposed in parallel so as to be spaced apart from each other at predetermined intervals. Each of the units 10Y, 10M, 10C and 10K may be a process cartridge that is detachably provided to the body of the image forming apparatus.

An intermediate transfer belt 20 as an intermediate transfer body extends so as to overlie the units 10Y, 10M, 10C, and 10K in the drawing and runs through the individual units. The intermediate transfer belt 20 is wound around a driving roller 22 and support roller 24 that are spaced apart from each other in the lateral direction in the drawing and runs in the direction from the first unit 10Y to the fourth unit 10K, the support roller 24 being in contact with the inner surface of the intermediate transfer belt 20. The support roller 24 receives force applied by a spring or another member (not illustrated) in the opposite direction to the driving roller 22, so that the intermediate transfer belt 20 wound around these rollers is under tension. An intermediate transfer body cleaning device 28 is provided on the intermediate transfer belt 20 on the side of the image holding member so as to face the driving roller 22, and a second transfer roller 26 (example of the second transfer unit) is provided so as to face the support roller 24.

Toners including four color toners of yellow, magenta, cyan, and black accommodated in toner cartridges 8Y, 8M, 8C, and 8K are supplied to developing devices (developing units) 4Y, 4M, 4C, and 4K of the units 10Y, 10M, 10C, and 10K, respectively.

In the image forming apparatus according to the exemplary embodiment, the specific toner is used as at least one of the four color toners. In order to give fixability at low temperature, all of the toners used in the image forming apparatus are suitably the specific toner.

Since each of the first to fourth units 10Y, 10M, 10C, and 10K has the same structure, the first unit 10Y that is disposed on the upstream side in the rotational direction of the intermediate transfer belt to form yellow images is herein described as a representative example of the image forming unit. The components of the second to fourth units 10M, 10C and 10K that are equivalent to those of the first unit 10Y are denoted by reference symbols having the characters M for magenta, C for cyan, and K for black, respectively, as in the components of the first unit 10Y denoted by reference symbols having the character Y for yellow, thereby omitting description of the second to fourth units 10M, 10C and 10K.

The first unit 10Y includes a photoreceptor 1Y that serves as an image holding member. The first unit 10Y has the following constituents provided around the photoreceptor 1Y in this order: a charging roller 2Y which charges the surface of the photoreceptor 1Y to a predetermined electric potential (example of the image holding member charging unit), an exposure device 3 in which the charged surface is exposed to a laser beam 3Y on the basis of image signals separately corresponding to different colors to form an electrostatic latent image (example of the electrostatic latent image forming unit), a developing device 4Y which supplies charged toner to the electrostatic latent image to develop the electrostatic latent image (example of the developing unit), a first transfer roller 5Y which transfers the developed toner image onto the intermediate transfer belt 20 (example of the first transfer unit), and a photoreceptor cleaning device 6Y which removes the toner remaining on the surface of the photoreceptor 1Y after the first transfer (example of the cleaning unit).

The first transfer roller 5Y is disposed inside the intermediate transfer belt 20 so as to face the photoreceptor 1Y. The first transfer rollers 5Y, 5M, 5C, and 5K are individually connected to bias supplies (not illustrated) used for applying a first transfer bias. The bias supplies are controlled by a controller (not illustrated) to adjust the transfer bias to be applied to the corresponding first transfer roller.

The image forming apparatus illustrated in FIG. 1 includes a fixing device 30 (example of the fixing unit) including paired rollers (example of the two rotational members) of which the outer surfaces are opposite to and in contact with each other to form a nipping region (namely, nip part).

A first charger 40 (example of the first charging unit) that charges particles and a second charger 42 (example of the second charging unit) that charges the second side of the recording medium, which is opposite to the first side, to the opposite polarity to the charged particles after the recording medium passes through the nipping region are disposed in the vicinity of the nipping region of the fixing device 30 and downstream of the nipping region in the transport direction (direction denoted by the arrow) of recording paper P (example of the recording medium).

The first charger 40 is disposed so as to face the toner-image-formed side of the recording paper P (corresponding to the first side), and the second charger 42 is disposed on the opposite side to the toner-image-formed side of the recording paper P (corresponding to the second side).

The fixing unit, the first charging unit, and the second charging unit will be described later in detail.

A process for forming yellow images with the first unit 10Y will now be described.

In advance of the process, the surface of the photoreceptor 1Y is charged to an electric potential ranging from −600 V to −800 V with the charging roller 2Y.

The photoreceptor 1Y has a conductive substrate (for example, volume resistivity at 20° C.: $1\times10^{-6}$ Ωcm or less) and a photosensitive layer formed thereon. The photosensitive layer normally has a high resistance (resistance of general resins); in the case where the photosensitive layer is irradiated with the laser beam 3Y, the specific resistance of the part irradiated with the laser beam changes.

The laser beam 3Y is emitted from the exposure device 3 to the charged surface of the photoreceptor 1Y on the basis of image data for yellow that has been transmitted from a controller (not illustrated). The laser beam 3Y is radiated to the photosensitive layer that is the surface of the photoreceptor 1Y, so that an electrostatic latent image of a yellow image pattern is formed on the surface of the photoreceptor 1Y.

The electrostatic latent image herein refers to an image formed on the surface of the photoreceptor 1Y owing to charging and is a so-called negative latent image formed as follows: part of the photosensitive layer is irradiated with the laser beam 3Y to decrease the specific resistance thereof, and this causes the release of electric charges on the charged surface of the photoreceptor 1Y whereas electric charges remain in another part not irradiated with the laser beam 3Y.

The electrostatic latent image formed on the photoreceptor 1Y is carried to a predetermined developing position by the rotation of the photoreceptor 1Y. The electrostatic latent image on the photoreceptor 1Y is developed into a visible image (developed image) as a toner image at this developing position by the developing device 4Y.

The developing device 4Y, for instance, contains a developer containing at least a yellow toner and a carrier. The yellow toner is stirred in the developing device 4Y for frictional charging, has electric charges exhibiting the same polarity (negative polarity) as the electric charges on the charged photoreceptor 1Y, and is held on a developer roller. The surface of the photoreceptor 1Y passes through the developing device 4Y, so that the yellow toner electrostatically adheres to a latent image part, from which electric charges have been released, on the surface of the photoreceptor 1Y; thus, the latent image is developed with the yellow toner. The photoreceptor 1Y on which the yellow toner image has been formed continues to rotate at a predetermined speed, and the toner image developed on the photoreceptor 1Y is conveyed to a predetermined first transfer position.

When the yellow toner image on the photoreceptor 1Y is conveyed to the first transfer, a first transfer bias is applied to the first transfer roller 5Y, and an electrostatic force directed from the photoreceptor 1Y toward the first transfer roller 5Y acts on the toner image, so that the toner image on the photoreceptor 1Y is transferred onto the intermediate transfer belt 20. In this case, the transfer bias to be applied has a polarity (positive) opposite to that of the toner (negative polarity); for instance, the bias is controlled to +10 μA by a controller (not illustrated) in the first image forming unit 10Y.

Meanwhile, the toner remaining on the photoreceptor 1Y is removed by the photoreceptor cleaning device 6Y and then recovered.

First transfer biases to be applied to the first transfer roller 5M of the second unit 10M and the other first transfer rollers 5C and 5K are controlled as in the first unit 10Y.

In this manner, the part of the intermediate transfer belt 20 to which the yellow toner image has been transferred by the first unit 10Y successively passes through the second to fourth units 10M, 10C and 10K, and toner images of respective colors are superimposed and multi-transferred.

The four-color toner images that have been multi-transferred to the intermediate transfer belt 20 through the first to fourth units are conveyed to a second transfer portion that includes the intermediate transfer belt 20, the support roller 24 being in contact with the inner surface of the intermediate transfer belt 20, and the second transfer roller 26 (example of the second transfer unit) disposed so as to face the image holding side of the intermediate transfer belt 20. The recording paper P is fed with a feeding mechanism at a predetermined timing to a gap at which the second transfer roller 26 is in contact with the intermediate transfer belt 20, and a second transfer bias is applied to the support roller 24. The transfer bias to be applied at this time has a polarity (negative) the same as that of the toner (negative polarity), and an electrostatic force directed from the intermediate transfer belt 20 toward the recording paper P acts on the toner image, so that the toner image on the intermediate transfer belt 20 is transferred onto the recording paper P. In this case, the second transfer bias is determined on the basis of a resistance detected by a resistance detector (not illustrated) used for detecting a resistance of the second transfer portion, and its voltage is controlled.

The recording paper P is subsequently transported to the nipping region (nip part) formed by the paired rollers of the fixing device 30 and then passes through the nipping region to fix the toner image to the first side of the recording paper P, thereby forming a fixed image.

UFPs generated downstream of the nipping region of the fixing device 30 in the transport direction of the recording paper P (direction denoted by the arrow) are charged by the first charger 40 that charges particles and then stick to the first side of the recording paper P charged to the opposite polarity to the charged particles by the second charger 42.

Examples of the recording paper P to which the toner image is transferred include plain paper used in electrophotographic copying machines, printers, and other apparatuses. Besides the recording paper P, the recording medium may be, for instance, an overhead projector (OHP) sheet.

The surface of the recording paper P is suitably smooth in order to enhance the smoothness of the surface of the image after the fixing process; for example, coated paper in which the surface of plain paper is coated with resin or another material and printing art paper are suitably used.

The recording paper P is transported to a discharge portion after the fixing of a color image is finished, and the process for forming color images is completed.

In the image forming apparatus according to the exemplary embodiment, UFPs generated downstream of the nipping region of the fixing device 30 in the transport direction of the recording paper P (direction denoted by the arrow) stick to the first side of the recording paper P and then are discharged from the discharge portion in this state (in a fused state depending on the temperature of the recording paper P).

In particular, the UFPs generated downstream of the nipping region of the fixing device 30 in the transport direction of the recording paper P (direction denoted by the arrow) are collected by the recording paper P having a fixed image, so that the amount of the UFPs discharged to the outside of the apparatus is reduced.

Fixing Unit, First Charging Unit, and Second Charging Unit

The fixing unit, first charging unit, and second charging unit used in the image forming apparatus according to the exemplary embodiment will be described in detail.

The fixing unit includes two rotational members of which the outer surfaces are opposite to and in contact with each other to form a nipping region and allows a recording medium having a transferred toner image to pass through the nipping region to fix the toner image to the first side of the recording medium.

The first charging unit is disposed in the vicinity of the nipping region and downstream of the nipping region in the transport direction of the recording medium so as to face the first side of the recording medium and charges particles.

The second charging unit charges the second side of the recording medium, which is opposite to the first side, to the opposite polarity to the charged particles after the recording medium passes through the nipping region.

The first charging unit does not only affect UFPs derived from the release agent but also may charge airborne particles other than the UFPs derived from the release agent.

First Example of Fixing Unit, First Charging Unit, and Second Charging Unit

A first example of the fixing unit, first charging unit, and second charging unit will be described with reference to FIG. 2.

Figure 2:
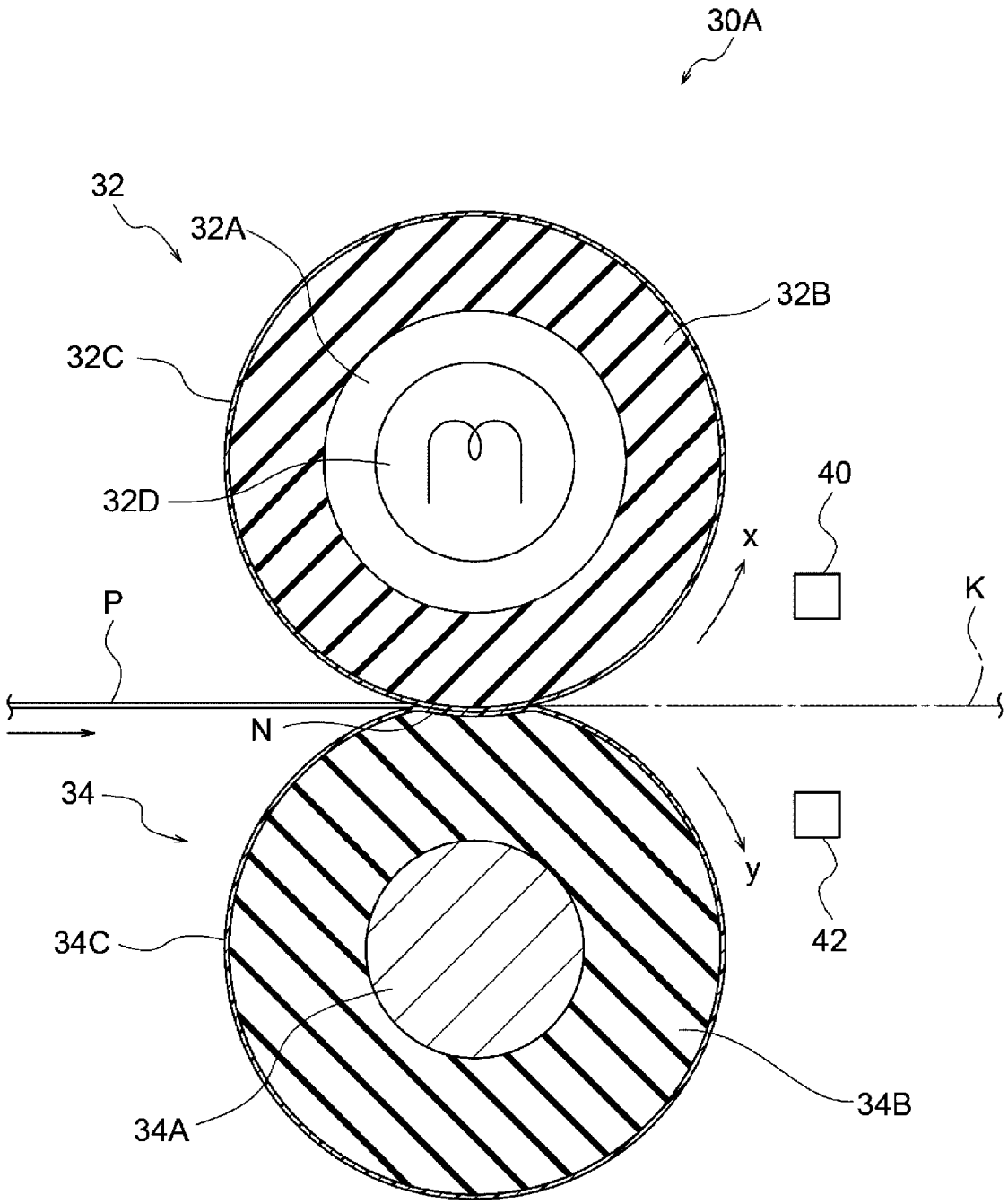
FIG. 2 is a cross-sectional view schematically illustrating an example of a fixing device, first charger, and second charger used in the image forming apparatus according to the exemplary embodiment.

FIG. 2 is a cross-sectional view schematically illustrating an example of the fixing device, first charger, and second charger used in the image forming apparatus according to the exemplary embodiment.

In the first example and a second example, members having substantially the same functions are denoted by the same reference signs, and description thereof is omitted.

In a fixing device 30A of the first example, the two rotational members are paired rollers that are a heating roller 32 which has an internal heating member and a pressure roller 34 which presses the recording paper P (example of the recording medium) against the heating roller 32 as illustrated in FIG. 2.

The heating roller 32 is disposed in contact with the pressure roller 34 so as to face the pressure roller 34 with a transport path K for transporting the recording paper P being interposed therebetween as illustrated in FIG. 2. The transport path in the exemplary embodiment refers to a path through which the lower side of the recording medium (namely, second side) passes in the transportation of the recording medium (recording paper P).

The heating roller 32 has a cylindrical core 32A, an elastic layer 32B covering the core 32A, and a surface layer 32C covering the elastic layer 32B. An adhesive layer may be provided at one or both of the boundaries between the core 32A and the elastic layer 32B and between the elastic layer 32B and the surface layer 32C.

A heating source 32D (example of the internal heating member) that heats the heating roller 32 from within is disposed inside the heating roller 32.

Examples of the material of the core 32A include metals, such as stainless steel (SUS), iron, and copper; alloys; fiber reinforced metals (FRM); and ceramics.

Examples of the material of the elastic layer 32B include a silicone rubber and a fluororubber.

Examples of the material of the surface layer 32C include a fluororubber, as silicone rubber, and a fluororesin: in terms of release properties, a fluororesin is suitable.

Examples of the material of the adhesive layer include primers primarily containing polyamide, polyimide, polyamide imide, or polyarylene sulfide and silicone-modified primers thereof.

The heating roller 32 suitably includes the elastic layer 32B having a thickness from 1.0% to 10.0% (preferably from 2.0% to 7.0%) of the diameter thereof in terms of efficient heating of a toner image.

The heat source 32D is, for example, one or more halogen lamps. The heat source is not limited to a halogen lamp and may be another heating element that emits heat.

The heat emitted from the heat source 32D is transmitted to the core 32A, the elastic layer 32B, and the surface layer 32C to increase the surface temperature of the heating roller 32.

A thermo-sensor (not illustrated) may be, for instance, provided in contact with the surface of the heating roller 32. The heating by the heat source 32D is controlled on the basis of the temperature measured by the thermo-sensor, and the surface temperature of the heating roller 32 is maintained at the intended fixing temperature (for example, 150° C.)

The fixing temperature of the heating roller 32 is preferably from 100° C. to 200° C., and more preferably from 120° C. to 200° C. in terms of the fixability of the toner at low temperature.

The pressure roller 34 is disposed under the transport path K for transporting the recording paper P as illustrated in FIG. 2.

The pressure roller 34 has a columnar core 34A, an elastic layer 34B covering the core 34A, and a surface layer 34C covering the elastic layer 34B. An adhesive layer may be provided at one or both of the boundaries between the core 34A and the elastic layer 34B and between the elastic layer 34B and the surface layer 34C.

Both the two ends of the core 34A are supported by a supporting member such that the pressure roller 34 can rotate, and a pushing member pushes the pressure roller 34 via the supporting member against the heating roller 32. This structure enables the pressure roller 34 to press the transported recording paper P against the heating roller 32.

The materials of the core 34A, elastic layer 34B, surface layer 34C, and adhesive layer are the same as those of the core 32A, elastic layer 32B, surface layer 32C, and adhesive layer of the heating roller 32, respectively; and the suitable examples thereof are also the same.

In this structure, a nipping region N is formed between the heating roller 32 and the pressure roller 34. The heating roller 32 is, for instance, rotated by a driving motor (not illustrated) in the direction denoted by the arrow x, and this rotation of the heating roller 32 causes the pressure roller 34 to rotate in the direction denoted by the arrow y.

The recording paper P passes through the nipping region between the heating roller 32 and the pressure roller 34, so that the paired rollers 30A fix the toner image formed on the recording paper P to the recording paper P.

The first charger 40 and the second charger 42 are disposed in the vicinity of the nipping region N of the fixing device 30A and downstream of the nipping region N in the transport direction of the recording paper P as illustrated in FIG. 2.

The first charger 40 is disposed above the transport path K for transporting the recording paper P; in particular, it is disposed so as to face the toner-image-formed side of the recording paper P (corresponding to the first side).

The second charger 42 is disposed below the transport path K for transporting the recording paper P; in particular, it is disposed so as to face opposite side of the recording paper P to the toner-image-formed side (corresponding to the second side).

The first charger 40 may be any charging device provided that it can charge airborne particles, and examples thereof include corona discharge devices and plasma discharge devices.

In particular, corona discharge devices are suitable because they are easily available and have a simple structure.

The charging type may be either a direct current (DC) charging type or an alternate current (AC) charging type. A DC charging type is suitable because it is more secure.

The position and number of the first charger 40 may be determined on the basis of the shape, size, and another structure of the charging device that is to be used.

In the case where the first charger 40 is a long charging device, for example, a single charging device may be used and disposed such that the longitudinal direction thereof is along the direction vertical to the transport direction of the recording medium (namely, the axial direction of the heating roller 32 and pressure roller 34).

In the case where the first charger 40 is a short charging device, multiple charging devices may be used and disposed at intervals along the direction vertical to the transport direction of the recording medium (namely, the axial direction of the heating roller 32 and pressure roller 34).

The first charger 40 is disposed in the vicinity of the nipping region N and downstream of the nipping region N in the transport direction of the recording paper P, and this means that the position of the first charger 40 is within such a distance from the downstream end of the nipping region N in the transport direction of the recording paper P that particles including UFPs can be efficiently charged.

Specifically, the minimum distance from the downstream end of the nipping region in the transport direction to the first charger 40 is suitably from 30 mm to 70 mm.

The minimum distance from the transport direction K to the first charger 40 is suitably from 10 mm to 40 mm in order to efficiently attach particles including UFPs to the recording medium.

The minimum distance from the outer surface of the heating roller 32 to the first charger 40 is suitably from 15 mm to 50 mm in order to efficiently charge particles including UFPs.

The second charger 42 may be any charging device provided that it can charge the recording paper P; the charging device may be in contact with or in non-contact with the recording paper P to charge the recording paper P. Examples of the second charger 42 include corona discharge devices and plasma discharge devices.

In particular, corona discharge devices are suitable because they are easily available and have a simple structure.

The charging type may be either a DC charging type or an AC charging type. A DC charging type is suitable because it is more secure.

The position and number of the second charger 42 may be determined on the basis of the shape, size, and another structure of the charging device that is to be used.

In the case where the second charger 42 is a long charging device, for example, a single charging device may be used and disposed such that the longitudinal direction thereof is along the direction vertical to the transport direction of the recording medium (namely, the axial direction of the heating roller 32 and pressure roller 34).

In the case where the second charger 42 is a short charging device, multiple charging devices may be used and disposed at intervals along the direction vertical to the transport direction of the recording medium (namely, the axial direction of the heating roller 32 and pressure roller 34).

The second charger 42 is suitably disposed in the vicinity of the nipping region N and downstream of the nipping region N in the transport direction of the recording paper P. The second charger 42 is disposed below the transport path K for transporting the recording paper P as illustrated in FIG. 2 in order to efficiently attach particles including the UFPs charged by the first charger 40 to the recording paper P; in particular, it is disposed so as to face the opposite side of the recording paper P to the toner-image-formed side (corresponding to the second side).

The second charger 42 is disposed in the vicinity of the nipping region N and downstream of the nipping region N in the transport direction of the recording paper P, and this means that the position of the second charger 42 is within such a distance from the downstream end of the nipping region N in the transport direction of the recording paper P that particles including the charged UFPs can be efficiently attached to the recording paper P.

Specifically, the minimum distance from the downstream end of the nipping region in the transport direction to the second charger 42 is suitably from 30 mm to 70 mm.

The minimum distance from the transport direction K to the second charger 42 is suitably from 0 mm to 30 mm in order to efficiently charge the recording medium.

The minimum distance from the outer surface of the pressure roller 34 to the second charger 42 is suitably from 20 mm to 40 mm in order to efficiently attach particles including the UFPs to the recording paper P.

Second Example of Fixing Unit, First Charging Unit, and Second Charging Unit

A second example of the fixing unit, first charging unit, and second charging unit will be described with reference to FIG. 3.

Figure 3:
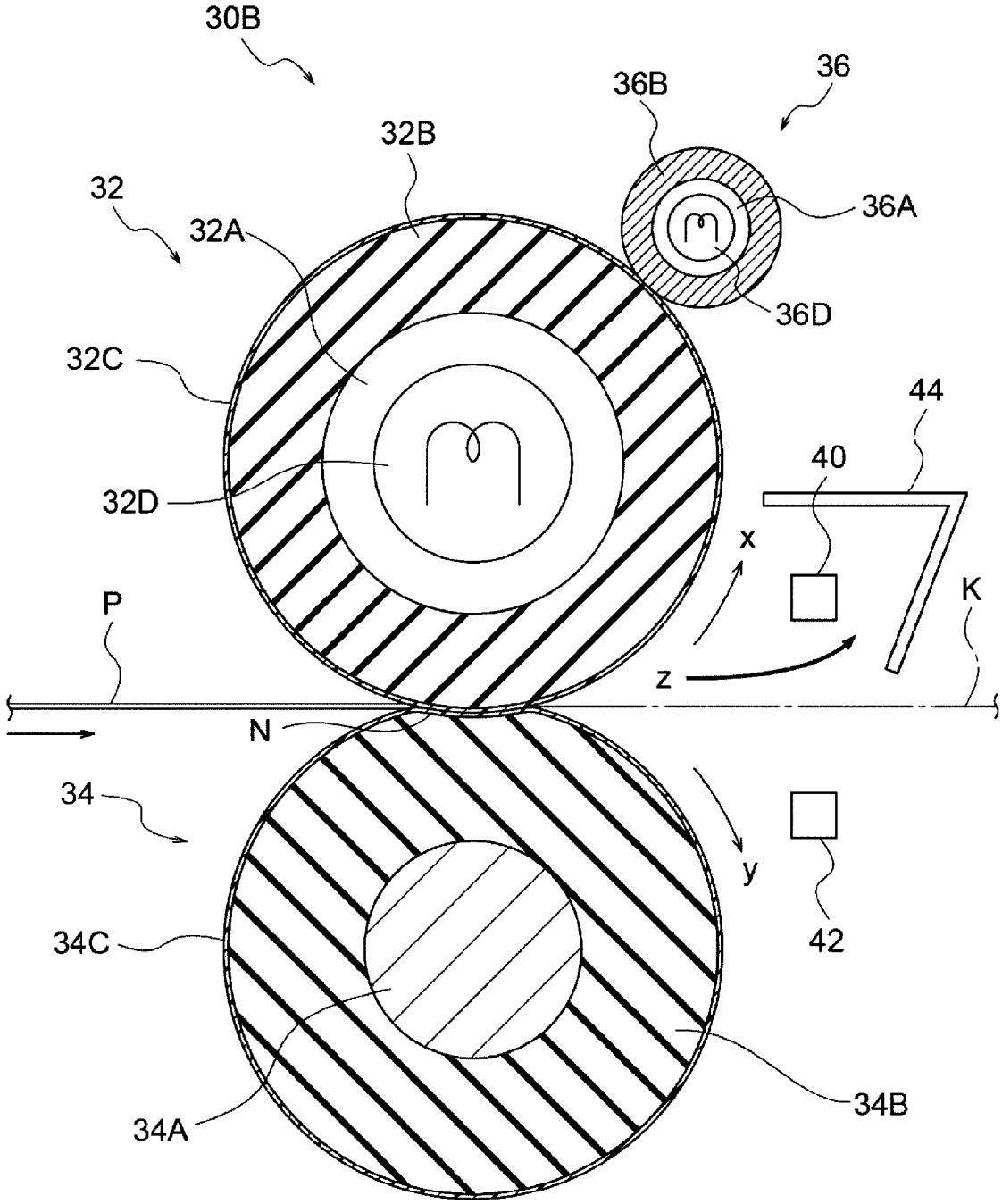
FIG. 3 is a cross-sectional view schematically illustrating another example of the fixing device, first charger, and second charger used in the image forming apparatus according to the exemplary embodiment.

FIG. 3 is a cross-sectional view schematically illustrating another example of the fixing device, first charger, and second charger used in the image forming apparatus according to the exemplary embodiment.

In a fixing device 30B of the second example, the two rotational members are paired rollers that are the heating roller 32 which has an internal heating member and the pressure roller 34 which presses the recording paper P (example of the recording medium) against the heating roller 32 as illustrated in FIG. 3. In addition, the fixing device 30B includes an external heating roller 36 (example of the external heating unit) that is in contact with the outer surface of the heating roller 32.

The external heating roller 36 is disposed in contact with the outer surface of the heating roller 32 as illustrated in FIG. 3. The external heating roller 36 may be in contact with the heating roller 32 at any position except for the nipping region between the heating roller 32 and the pressure roller 34.

The external heating roller 36 includes a cylindrical core 36A, an elastic layer 36B covering the core 36A, and a heat source 36D provided inside the core 36A.

The external heating roller 36 is forced to be rotated by the rotation of the heating roller 32 to heat the heating roller 32. Since the external heating roller 36 heats the heating roller 32 that has the heat source 32D within, the surface temperature of the hating roller 32 can be adjusted to the intended fixing temperature even when a process speed is increased (for example, at 220 mm/s or more).

The fixing temperature of the heating roller 32 in the fixing device 30B is preferably from 100° C. to 200° C., and more preferably from 120° C. to 200° C. in terms of the fixability of the toner at low temperature.

The preset surface temperature of the external heating roller 36 is preferably from 100° C. to 200° C., and more preferably from 120° C. to 200° C. from the same point of view.

The term "preset surface temperature" of the external heating roller 36 refers to a desired surface temperature of the external heating roller 36 at the moment of the contact with the heating roller 32 in such a state that the heating roller 32 has not received the heat.

As illustrated in FIG. 3, the first charger 40 and the second charger 42 are disposed in the vicinity of the nipping region N of the fixing device 30B and downstream of the nipping region N in the transport direction of the recording paper P as in the first example illustrated in FIG. 2.

The first charger 40 is similarly disposed above the transport path K for transporting the recording paper P; in particular, it is disposed so as to face the toner-image-formed side of the recording paper P (corresponding to the first side).

The second charger 42 is disposed below the transport path K for transporting the recording paper P; in particular, it is disposed so as to face opposite side of the recording paper P to the toner-image-formed side (corresponding to the second side).

The fixing device 30B of the second example illustrated in FIG. 3 further includes a straightening plate 44 (example of the straightening plate) having a cross-sectional shape bent at the center.

The rotation of the heating roller 32 (in the direction denoted by the arrow x) and the transportation of the recording paper P generate an airstream (for instance, airstream flowing in the direction denoted by the arrow z in FIG. 3) in the vicinity of the nipping region N and downstream of the nipping region N in the transport direction of the recording paper P. The UFPs generated downstream of the nipping region N in the transport direction of the recording paper P are therefore diffused by the airstream flowing in the direction denoted by the arrow z in FIG. 3. Hence, the straightening plate 44 is provided to form an airstream flowing from the downstream end of the nipping region N in the transport direction of the recording paper P to the first charger 40. The straightening plate 44 can turn the airstream flowing in the direction denoted by the arrow z in FIG. 3 toward the first charger 40, so that the diffusion of the UFPs is reduced; thus, the efficiency for the first charger 40 to charge the UFPs can be enhanced.

The structure including the straightening plate makes it easier to reduce the amount of UFPs discharged to the outside of the apparatus.

The straightening plate 44 has a cross-sectional shape bent at the center as illustrated in FIG. 3, but the shape of the straightening plate 44 is not limited thereto. The straightening plate 44 can be any shape provided that it can form an airstream flowing from the downstream end of the nipping region N in the transport direction of the recording paper P to the first charger 40.

The shape, angle, or another structure of the straightening plate 44 may be appropriately determined on the basis of the shape, size, position, or another structure of the first charger 40.

The straightening plate 44 is suitably a long planar member and disposed such that the longitudinal direction of the planar member is along the direction vertical to the transport direction of the recording medium (namely, the axial direction of the heating roller 32 and the pressure roller 34) because this structure easily enables formation of the airstream flowing to the first charger 40.

The material of the straightening plate 44 is not particularly limited and may be, for example, resin, metal, or ceramic.

Although the first example and the second example have been described, the fixing unit, the first charging unit, and the second charging unit are not limited thereto; for instance, the fixing unit of the first example may be combined with the first charging unit and second charging unit of the second example, and the fixing unit of the second example may be combined with the first charging unit and second charging unit of the first example.

Developer

The toner used in the developer accommodated in the developing unit of the image forming apparatus according to the exemplary embodiment will now be described in detail.

The detail of the toner used in the exemplary embodiment will now be described.

The toner used in the exemplary embodiment contains toner particles and optionally an external additive.

Toner Particles

The toner particles, for example, contain a binder resin, a release agent, and optionally a colorant and another additive.

Release Agent

The melting temperature of the release agent is from 60° C. to 100° C., preferably from 60° C. to 90° C., and more preferably from 60° C. to 75° C.

The melting temperature of the release agent at 100° C. or less enables an enhancement in the fixability of the toner at low temperature, so that the fixing temperature in the image forming apparatus can be lowered. At 100° C. or less of the melting temperature of the release agent, the release agent is likely to be vaporized in the fixing of the toner, and the vaporized release agent re-solidifies in air, which easily results in the generation of the UFPs. Even in this case, however, the amount of the UFPs discharged to the outside of the image forming apparatus is reduced according to the exemplary embodiment.

The melting temperature of the release agent at 60° C. or more reduces the adhesion of the release agent to the fixing member due to the unnecessary melting of the release agent in the fixing of the toner. In addition, such a melting temperature can reduce the excessive generation of the UFPs.

The melting temperature of the release agent can be controlled by any of known techniques, such as changing the type of release agent.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

Examples of the release agent include, but are not limited to, mineral or petroleum waxes such as a montan wax, an ozokerite wax, a ceresin wax, a paraffin wax, a micro crystalline wax, and a Fischer-Tropsch wax; hydrocarbon waxes such as a polyethylene wax, a polypropylene wax, and a polybutene wax; a silicone wax; fatty acid amide waxes such as an oleamide wax, an erucamide wax, a ricinoleamide wax, and a stearamide wax; botanical waxes such as a carnauba wax, a rice bran wax, a candelilla wax, a Japan wax, and a jojoba oil; animal waxes such as beeswax; ester waxes such as a fatty acid ester, a montanic acid ester, and a carboxylic acid ester; and modified products thereof.

Among these, a paraffin wax, a ceresin wax, a carnauba wax, a fatty acid ester, and a montanic acid ester are preferred in terms of the fixability of the toner at low temperature; and a paraffin wax is more preferred.

The release agents may be used alone or in combination. In the case where two or more release agents are used, it is suitable that at least one of the release agents have a melting temperature being in the above-mentioned range, and it is more suitable that all of them have a melting temperature being in the above-mentioned range.

The amount of the release agent is, for example, preferably from 1 mass % to 20 mass %, and more preferably from 5 mass % to 15 mass % relative to the amount of the whole toner particles.

Melting Temperature of Release Agent and Fixing Temperature

The difference between the melting temperature (T2) of the release agent and the fixing temperature (T1) of the fixing member of the image forming apparatus (namely, at least one rotational member of the two rotational members) (T1−T2) is preferably from 30° C. to 140° C., more preferably from 40° C. to 120° C., and further preferably from 50° C. to 100° C.

When the fixing temperature (T1) is higher than the melting temperature (T2) of the release agent and the difference therebetween (T1−T2) is 140° C. or less, the fixing temperature of the toner in the image forming apparatus can be lowered. When the temperature difference (T1−T2) is 30° C. or higher, the adhesion of the toner to the fixing member can be reduced in the fixing of the toner. At the temperature difference (T1−T2) of 30° C. or higher, however, the release agent is likely to be vaporized in the fixing of the toner, and the vaporized release agent resolidifies in air, which easily results in the generation of the UFPs. Even so, the amount of the UFPs discharged to the outside of the apparatus is reduced according to the exemplary embodiment.

The term "fixing temperature" of the fixing member refers to a desired temperature of part of the surface, which comes into contact with an unfixed toner image, of the fixing member. In other words, it is a desired surface temperature of the fixing member (namely, heated rotational member such as the heating roller) at the moment of the contact with an unfixed toner image in such a state that the unfixed toner image has not received the heat.

Binder Resin

Examples of the binder resin include vinyl resins that are homopolymers of monomers such as styrenes (such as styrene, p-chlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or copolymers of two or more of these monomers.

Other examples of the binder resin include non-vinyl resins such as epoxy resins, polyester resins, polyurethane resins, polyamide resins, cellulose resins, polyether resins, and modified rosin; mixtures thereof with the above-mentioned vinyl resins; and graft polymers obtained by polymerization of a vinyl monomer in the coexistence of such non-vinyl resins.

These binder resins may be used alone or in combination.

The binder resin suitably contains a crystalline resin in order to enhance the fixability of the toner at low temperature.

The binder resin is suitably a polyester resin. In particular, the binder resin is suitably crystalline polyester.

Examples of the polyester resin include known amorphous polyester resins. The polyester resin may be a combination of the amorphous polyester resin and a crystalline polyester resin.

The "crystallinity" of a resin refers to that the resin does not have a stepwise change in the amount of heat absorption but have a definite endothermic peak in the differential scanning calorimetry (DSC). Specifically, it refers to that the half-value width of the endothermic peak in the measurement at a rate of temperature increase of 10 (° C./min) is within 10° C.

The "amorphous properties" of a resin refers to that the half-value width of the endothermic peak exceeds 10° C., that a stepwise change in the amount of heat absorption is exhibited, or that definite endothermic peak is not observed.

Amorphous Polyester Resin

Examples of the amorphous polyester resin include polycondensates of a polycarboxylic acid with a polyhydric alcohol. The amorphous polyester resin may be a commercially available product or may be a synthesized resin.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitable as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing.

Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). Among these, for example, aromatic diols and alicyclic diols are preferred as the polyhydric alcohol, and aromatic diols are more preferred.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol.

Such polyhydric alcohols may be used alone or in combination.

The amorphous polyester resin has a glass transition temperature (Tg) ranging preferably from 50° C. to 80° C., and more preferably from 50° C. to 65° C.

The glass transition temperature is determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics".

The amorphous polyester resin has a weight average molecular weight (Mw) ranging preferably from 5000 to 1000000, and more preferably from 7000 to 500000.

The amorphous polyester resin suitably has a number average molecular weight (Mn) ranging from 2000 to 100000.

The amorphous polyester resin has a molecular weight distribution Mw/Mn ranging preferably from 1.5 to 100, and more preferably from 2 to 60.

The weight average molecular weight and number average molecular weight are measured by gel permeation chromatography (GPC). The measurement of the molecular weight by GPC involves using a measurement apparatus that is GPC•HLC-8120GPC manufactured by Tosoh Corporation, a column that is TSK gel Super HM-M (15 cm) manufactured by Tosoh Corporation, and a tetrahydrofuran (THF) solvent. From results of such measurement, the weight average molecular weight and the number average molecular weight are calculated from a molecular weight calibration curve plotted on the basis of a standard sample of monodisperse polystyrene.

The amorphous polyester resin can be produced by any of known techniques. In particular, the amorphous polyester resin is, for example, produced through a reaction at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility are used in the copolymerization reaction, such monomers are preliminarily subjected to condensation with an acid or alcohol that is to undergo polycondensation with the monomers, and then the resulting product is subjected to polycondensation with the principle components.

Crystalline Polyester Resin

Examples of the crystalline polyester resin include polycondensates of a polycarboxylic acid with a polyhydric alcohol. The crystalline polyester resin may be a commercially available product or a synthesized resin.

The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids.

The polycarboxylic acid may be a combination of these dicarboxylic acids with a dicarboxylic acid having a sulfonic group or a dicarboxylic acid having an ethylenic double bond.

The polycarboxylic acids may be used alone or in combination.

Examples of the polyhydric alcohol include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol.

The polyhydric alcohols may be used alone or in combination.

The aliphatic diol content in the polyhydric alcohol may be 80 mol % or more, and suitably 90 mol % or more.

The melting temperature of the crystalline polyester resin is preferably from 50° C. to 100° C., more preferably from 55° C. to 90° C., and further preferably from 60° C. to 85° C.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The weight average molecular weight (Mw) of the crystalline polyester resin is suitably from 6,000 to 35,000.

The crystalline polyester resin can be, for example, produced by any of known techniques as in preparation of the amorphous polyester resin.

The amount of the binder resin is, for instance, preferably from 40 mass % to 95 mass %, more preferably from 50 mass % to 90 mass %, and further preferably from 60 mass % to 85 relative to the whole toner particles.

The amount of the crystalline resin is preferably from 3 mass % to 20 mass %, and more preferably from 5 mass % to 15 mass % relative to the whole toner particles in order to enhance the fixability of the toner at low temperature.

Colorant

Examples of the colorant include a variety of pigments, such as carbon black, chrome yellow, Hansa Yellow, benzidine yellow, Indanthrene yellow, quinoline yellow, pigment yellow, permanent orange GTR, pyrazolone Orange, Vulcan Orange, Watchung Red, Permanent Red, Brilliant Carmine 3B, Brilliant Carmine 6B, Du Pont Oil Red, pyrazolone red, lithol red, rhodamine B lake, lake red C, pigment red, rose bengal, aniline blue, ultramarine blue, chalco oil blue, methylene blue chloride, phthalocyanine blue, pigment blue, phthalocyanine green, and malachite green oxalate, and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination.

The colorant may be optionally a surface-treated colorant or may be used in combination with a dispersant. Different types of colorant may be used in combination.

The amount of the colorant is, for instance, preferably from 1 mass % to 30 mass %, and more preferably from 3 mass % to 15 mass % relative to the amount of the whole toner particles.

Other Additives

Examples of other additives include known additives such as a magnetic material, a charge-controlling agent, and inorganic powder. These additives are contained in the toner particles as internal additives.

Characteristics of Toner Particles

The toner particles may have a monolayer structure or may have a core shell structure including a core (core particle) and a coating layer (shell layer) that covers the core.

The toner particles having a core shell structure, for instance, properly include a core containing the binder resin and optionally an additive, such as a colorant or a release agent, and a coating layer containing the binder resin.

The volume average particle size (D50v) of the toner particles is preferably from 2 μm to 10 μm, and more preferably from 4 μm to 8 μm.

The average particle size of the toner particles and the index of the particle size distribution thereof are measured with COULTER MULTISIZER II (manufactured by Beckman Coulter, Inc.) and an electrolyte that is ISOTON-II (manufactured by Beckman Coulter, Inc.).

In the measurement, from 0.5 mg to 50 mg of a test sample is added to 2 ml of an aqueous solution of a 5% surfactant (suitably sodium alkylbenzene sulfonate) as a dispersant. This product is added to from 100 ml to 150 ml of the electrolyte.

The electrolyte suspended with the sample is subjected to dispersion for 1 minute with an ultrasonic disperser and then subjected to the measurement of the particle size distribution of particles having a particle size ranging from 2 μm to 60 μm using COULTER MULTISIZER II with an aperture having an aperture diameter of 100 μm. The number of sampled particles is 50,000.

Cumulative distributions by volume and by number are drawn from the smaller diameter side in particle size ranges (channels) into which the measured particle size distribution is divided. The particle size for a cumulative percentage of 16% is defined as a volume particle size D16v and a number particle size D16p, while the particle size for a cumulative percentage of 50% is defined as a volume average particle size D50v and a number average particle size D50p. Furthermore, the particle size for a cumulative percentage of 84% is defined as a volume particle size D84v and a number particle size D84p.

From these particle sizes, the index of the volume particle size distribution (GSDv) is calculated as $(D84v/D16v)^{1/2}$, while the index of the number particle size distribution (GSDp) is calculated as $(D84p/D16p)^{1/2}$.

The shape factor SF1 of the toner particles is suitably 140 or more, preferably from 140 to 155, more preferably from 143 to 153, and further preferably from 145 to 151.

In the case where the toner particles are produced by a pulverizing method such as a kneading pulverizing method, the shape of the toner particles is amorphous, and the shape factor SF1 is, for instance, 140 or more. In the toner particles having a shape factor SF1 of 140 or more, the release agent is likely to be exposed on the surface thereof owing to the production method. The release agent exposed on the surface is easily evaporated by the heat in the fixing of the toner, which readily results in the generation of the UFPs. Even in this case, however, the amount of the UFPs discharged to the outside of the image forming apparatus is reduced according to the exemplary embodiment.

The shape factor SF1 is given from the following equation.

$$SF1=(ML^2/A)\times(\pi/4)\times 100 \quad \text{Equation:}$$

In this equation, ML represents the absolute maximum length of toner, and A represents the projected area of toner.

Specifically, the shape factor SF1 is converted into numerals principally by analyzing a microscopic image or a scanning electron microscopic (SEM) image with an image analyzer and calculated as follows. In particular, the optical microscopic image of particles scattered on the surface of a glass slide is input to an image analyzer LUZEX through a video camera to measure the maximum lengths and projected areas of 100 particles, the SF1 is calculated for them from the above equation, and the average thereof is obtained.

The toluene insoluble content in the toner particles is preferably from 25 mass % to 40 mass %, more preferably from 28 mass % to 38 mass %, and further preferably from 30 mass % to 35 mass %.

The toluene insoluble content in the toner particles in such a range enables the release agent to be confined in the toner particles, which reduces the exposure of the release agent on the surface of the toner particles. Thus, the generation of the UFPs derived from the release agent is reduced.

The toluene-insoluble component of the toner particles refers to the component that is contained in the toner particles but not dissolved in toluene. In other words, the toluene-insoluble component is an insoluble matter of which the principle component (for instance, 50 mass % or more of the whole) is a component of the binder resin that is not dissolved in toluene (particularly high-molecular-weight component of binder resin). The amount of the toluene-insoluble component can be an index of the cross-linked resin content in the toner.

The amount of the toluene-insoluble component is measured as follows.

Toner particles (or toner) weighed to 1 g are put into weighed cylindrical filter paper made of glass fibers, and this cylindrical filter paper is attached to the extraction tube of a thermal Soxhlet extractor. Toluene is put into a flask and heated to 110° C. with a mantle heater. A heater attached to the extraction tube is used to heat the surrounding of the extraction tube to 125° C. The extraction is performed at such a reflux rate that a single cycle of extraction is in the range of four minutes to five minutes. After the extraction is performed for 10 hours, the cylindrical paper filter and residual toner are retrieved, dried, and weighed.

Then, the amount (mass %) of the toner particle residue (or toner residue) is calculated on the basis of the following equation and defined as the amount of the toluene-insoluble component (mass %).

amount (mass %) of toner particle residue (or toner residue)=[(weight of cylindrical filter paper+weight of residual toner) (g)−weight of cylindrical filter paper (g)]÷mass (g) of toner particles (or toner)×100 Equation:

The toner particle residue (or toner residue) contains, for example, a colorant, an inorganic substance such as an external additive, and the high-molecular-weight component of the binder resin. In the case where the toner particles contain a release agent, the release agent is a toluene-soluble component because the extraction is carried out through heating.

The toluene-insoluble component of the toner particles is, for example, adjusted by (1) adding a cross-linking agent to a high-molecular-weight component having a reactive functional group at its end to form a cross-linked structure or a branched structure in the binder resin, (2) using a polyvalent metal ion in the binder resin to form a cross-linked structure or a branched structure in a high-molecular-weight component having an ionic functional group at its end, or (3) using, for instance, isocyanate in the binder resin to extend the chain structure of the resin or to allow it to branch.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles as an external additive may be hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination The amount of the hydrophobizing agent is, for instance, generally from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high-molecular-weight fluorine material).

The amount of the external additive to be used is, for example, preferably from 0.01 mass % to 5 mass %, and more preferably from 0.01 mass % to 2.0 mass % relative to the amount of the toner particles.

Preparation of Toner

Preparation of the toner used in the exemplary embodiment will now be described.

The toner used in the exemplary embodiment can be produced by preparing toner particles and then externally adding an external additive to the toner particles.

The toner particles may be produced by any of a dry process (such as a kneading pulverizing method) and a wet process (such as an aggregation coalescence method, a suspension polymerization method, or a dissolution suspension method). Preparation of the toner particles is not particularly limited to these preparation processes, and any of known techniques can be employed.

In particular, the toner particles are suitably produced by an aggregation coalescence method.

Aggregation Coalescence Method

Specifically, for example, preparation of the toner particles by an aggregation coalescence method includes the following processes:

preparing a dispersion liquid of resin particles in which resin particles as the binder resin have been dispersed (preparation of dispersion liquid of resin particles), aggregating the resin particles (optionally with other particles) in the dispersion liquid of resin particles (dispersion liquid optionally mixed with a dispersion liquid of other particles) to form an aggregated particles (formation of aggregated particles), and heating a dispersion liquid of aggregated particles in which the aggregated particles have been dispersed to fuse and coalesce the aggregated particles into toner particles (fusion and coalescence).

Each of the processes will now be described in detail.

In the following description, a method for producing the toner particles containing a colorant and a release agent will be explained; however, use of the colorant and the release agent is optional. Additives other than the colorant and the release agent may be obviously used.

Preparation of Dispersion Liquid of Resin Particles

The dispersion liquid of resin particles in which resin particles as a binder resin have been dispersed as well as, for example, a dispersion liquid of colorant particles in which colorant particles have been dispersed and a dispersion liquid of release agent particles in which release agent particles have been dispersed are prepared.

The dispersion liquid of the resin particles is, for example, prepared by dispersing the resin particles in a dispersion medium with a surfactant.

Examples of the dispersion medium used in the dispersion liquid of resin particles include aqueous media.

Examples of the aqueous media include water, such as distilled water and ion exchanged water, and alcohols. These aqueous media may be used alone or in combination.

Examples of the surfactant include anionic surfactants such as sulfuric acid ester salts, sulfonic acid salts, phosphoric acid esters, and soaps; cationic surfactants such as amine salts and quaternary ammonium salts; and nonionic surfactants such as polyethylene glycol, alkylphenol-ethylene oxide adducts and polyols. Among these surfactants, anionic surfactants and cationic surfactants may be used. Nonionic surfactants may be used in combination with anionic surfactants or cationic surfactants.

The surfactants may be used alone or in combination.

In the dispersion liquid of resin particles, the resin particles can be dispersed in the dispersion medium by any of known dispersion techniques; for example, general dispersers can be used, such as rotary shearing homogenizers or those having media, e.g., a ball mill, a sand mill, and a DYNO mill. Depending on the type of resin particles, the resin particles may be, for instance, dispersed in the dispersion liquid of resin particles by phase inversion emulsification.

In the phase inversion emulsification, a resin to be dispersed is dissolved in a hydrophobic organic solvent in which the resin can be dissolved, a base is added to an organic continuous phase (O phase) for neutralization, and then an aqueous medium (W phase) is added thereto to turn the phase to a discontinuous phase by the conversion of the resin (namely, phase inversion) from W/O to O/W, thereby dispersing the resin in the aqueous medium in the form of particles.

The volume average particle size of the resin particles to be dispersed in the dispersion liquid of resin particles is, for example, preferably from 0.01 μm to 1 μm, more preferably from 0.08 μm to 0.8 μm, and further preferably from 0.1 μm to 0.6 μm.

The volume average particle size of the resin particles is determined as follows. Particle size distribution is measured with a laser-diffraction particle size distribution analyzer (such as LA-700 manufactured by HORIBA, Ltd.), cumulative distribution by volume is drawn from the smaller particle size side in particle size ranges (channels) into which the measured particle size distribution is divided, and the particle size having a cumulative percentage of 50% relative to the whole particles is determined as the volume average particle size D50v. The volume average particle size of the particles in other dispersion liquids is similarly determined.

The amount of the resin particles contained in the dispersion liquid of resin particles is, for example, preferably from 5 mass % to 50 mass %, and more preferably from 10 mass % to 40 mass %.

The dispersion liquid of colorant particles and the dispersion liquid of release agent particles are, for instance, prepared in the same manner as the preparation of the dispersion liquid of resin particles. Accordingly, the volume average particle size of the particles, the dispersion medium, the dispersion method, and the amount of the particles in the dispersion liquid of resin particles are the same as those of the colorant particles dispersed in the dispersion liquid of colorant particles and the release agent particles dispersed in the dispersion liquid of release agent particles.

Formation of Aggregated Particles

The dispersion liquid of resin particles is mixed with the dispersion liquid of colorant particles and the dispersion liquid of release agent particles.

The resin particles, the colorant particles, and the release agent particles are hetero-aggregated in the mixed dispersion liquid to form aggregated particles having a diameter close to the intended diameter of the toner particles and containing the resin particles, the colorant particles, and the release agent particles.

Specifically, for example, an aggregating agent is added to the mixed dispersion liquid, and the pH of the mixed dispersion liquid is adjusted to be acidic (e.g., pH from 2 to 5). Then, a dispersion stabilizer is optionally added thereto, the resulting mixture is heated to a temperature corresponding to the glass transition temperature of the resin particles (in particular, for example, −30° C. or more and −10° C. or less of the glass transition temperature of the resin particles), and the particles dispersed in the mixed dispersion liquid are aggregated, thereby forming the aggregated particles.

In the formation of the aggregated particles, for instance, the aggregating agent may be added to the mixed dispersion liquid at room temperature (for instance, 25° C.) under stirring with a rotary shearing homogenizer, the pH of the mixed dispersion liquid may be adjusted to be acidic (e.g., pH from 2 to 5), a dispersion stabilizer may be optionally added thereto, and the resulting mixture may be heated.

Examples of the aggregating agent include surfactants having an opposite polarity to the surfactant used as a dispersant that is to be added to the mixed dispersion liquid, such as inorganic metal salts and di- or higher valent metal complexes. In the case where a metal complex is used as the aggregating agent, the surfactant can be used in a reduced amount, and charging properties can be improved.

An additive that forms a complex or a similar bond with the metal ions of the aggregating agent may be optionally used. Such an additive is suitably a chelating agent.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of the chelating agent include oxycarboxylic acids such as tartaric acid, citric acid, and gluconic acid; iminodiacetic acid (IDA); nitrilotriacetic acid (NTA); and ethylenediaminetetraacetic acid (EDTA).

The amount of the chelating agent is, for example, preferably from 0.01 parts by mass to 5.0 parts by mass, more preferably 0.1 part by mass or more and less than 3.0 parts by mass relative to 100 parts by mass of the resin particles.

Fusion and Coalescence

The dispersion liquid of aggregated particles in which the aggregated particles have been dispersed is, for example, heated to the glass transition temperatures or more of the resin particles (such as from 10° C. to 30° C. higher than the glass transition temperatures of the resin particles) to fuse and coalesce the aggregated particles, thereby forming the toner particles.

Through the above-mentioned processes, the toner particles are produced.

The method for forming the toner particles may have the following additional processes: after the dispersion liquid of aggregated particles in which the aggregated particles have been dispersed is obtained, the dispersion liquid of aggregated particles is further mixed with a dispersion liquid of resin particles in which the resin particles have been dispersed, and the particles are aggregated such that the resin particles further adhere to the surfaces of the aggregated particles to produce second aggregated particles; and a dispersion liquid of second aggregated particles in which the second aggregated particles have been dispersed is heated to fuse and coalesce the second aggregated particles, thereby producing toner particles having a core shell structure.

After the fusion and coalescence, the toner particles formed in the solution are washed, subjected to solid-liquid separation, and dried by known techniques to yield dried toner particles.

The washing may be sufficiently carried out by displacement washing with ion exchanged water in terms of charging properties. The solid-liquid separation is not particularly limited but may be suction filtration or pressure filtration in terms of productivity. The drying is not particularly limited but may be freeze drying, flush drying, fluidized drying, or vibratory fluidized drying in terms of productivity.

An external additive is, for instance, added to the produced toner particles that are in a dried state, and the resulting toner particles are mixed to produce the toner used in the exemplary embodiments. The mixing may be performed, for example, with a V-blender, a HENSCHEL MIXER, or a LOEDIGE MIXER. The coarse particles of the toner may be optionally removed with a vibrating sieve, an air sieve, or another device.

Kneading Pulverizing Method

The toner particles used in the exemplary embodiment may be produced by a pulverizing method such as a kneading pulverizing method. In the case where the toner particles are produced by a pulverizing method, the shape of the toner particles is amorphous, and the shape factor SF1 is, for example, in the above-mentioned range. The release agent is likely to be exposed on the surface of the toner particles owing to the production method, which readily results in the generation of the UFPs. Even in this case, however, the amount of the UFPs discharged to the outside of the apparatus is reduced according to the exemplary embodiment.

The toner particles are produced by a kneading pulverizing method through melt-kneading, pulverizing, and classifying the binder resin and a release agent at least containing a specific paraffin wax having a melting temperature being in the above-mentioned range. The preparation of the toner particles by the kneading pulverizing method, for instance, includes a kneading process of melt-kneading materials including the binder resin and the release agent, a cooling process of cooling the melt-kneaded product, a pulverizing process of pulverizing the melt-kneaded product after the cooling process, and a classifying process of classifying the pulverized product.

Each of the processes of the kneading pulverizing method will now be described in detail.

Kneading Process

In the kneading process, materials including the binder resin and the release agent (materials for producing resin particles) are melt-kneaded to produce a kneaded product.

Examples of a kneader used in the kneading process include a three-roll kneader, a uniaxial screw kneader, a biaxial screw kneader, and a Banbury mixer.

The melting temperature may be determined on the basis of the types of binder resin and release agent to be kneaded and the content proportion thereof.

Cooling Process

In the cooling process, the kneaded product obtained in the kneading process is cooled.

In the cooling process, the temperature of the kneaded product is suitably decreased from the temperature of the kneaded product at the completion of the kneading process to 40° C. at an average temperature decrease rate of 4° C./s or more in order to maintain the dispersion state immediately after the kneading process.

The term "average temperature decrease rate" refers to the average of the rate taken to decrease the temperature of the kneaded product at the completion of the kneading process up to 40° C.

In the cooling process, the cooling is, for example, performed with a rolling roller, in which cold water or brine circulates, or a pinching type cooling belt. In the cooling in this manner, the cooling rate is determined, for instance, on the basis of the speed of the rolling roller, the flow rate of the brine, the amount of the kneaded product to be supplied, or a slab thickness during the rolling of the kneaded product. The slab thickness is suitable from 1 mm to 3 mm.

Pulverizing Process

The kneaded product cooled in the cooling process is pulverized in a pulverizing process to form particles.

In the pulverizing process, for example, a mechanical pulverizer, a jet pulverizer, or another pulverizer is used.

Classifying Process

The pulverized product (particles) obtained in the pulverizing process may be optionally classified in the classifying process.

In the classifying process, a typical centrifugal classifier, inertial classifier, or another classifier is used to remove fine powder (particles having a particle size smaller than the intended size) and coarse powder (particles having a particle size larger than the intended size).

An external additive is, for instance, added to the produced toner particles that are in a dried state, and the resulting toner particles are mixed to produce the toner used in the exemplary embodiments. The mixing may be performed, for example, with a V-blender, a HENSCHEL MIXER, or a LOEDIGE MIXER. The coarse particles of the toner may be optionally removed with a vibrating sieve, an air sieve, or another device.

Developer

The developer used in the exemplary embodiment at least contains the toner used in the exemplary embodiment.

The developer used in the exemplary embodiment may be a single component developer containing only the toner used in the exemplary embodiment or may be a two component toner that is a mixture of the toner and a carrier.

The carrier is not particularly limited, and any of known carriers can be used. Examples of the carrier include coated carriers in which the surface of a core formed of magnetic powder has been coated with a coating resin, magnetic powder dispersed carriers in which magnetic powder has been dispersed in or blended with a matrix resin, and resin impregnated carriers in which porous magnetic powder has been impregnated with resin.

In the magnetic powder dispersed carriers and the resin impregnated carriers, the constituent particles may have a surface coated with a coating resin.

Examples of the magnetic powder include magnetic metals, such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins.

The coating resin and the matrix resin may contain other additives such as conductive particles.

Examples of the conductive particles include particles of metals such as gold, silver, and copper; carbon black particles; titanium oxide particles; zinc oxide particles; tin oxide particles; barium sulfate particles; aluminum borate particles; and potassium titanate particles.

An example of the preparation of the coated carrier involves coating with a coating layer forming solution in which the coating resin and optionally a variety of additives have been dissolved in a proper solvent. The solvent is not particularly limited and may be determined in view of, for instance, the type of coating resin to be used and coating suitability.

Specific examples of the coating method include a dipping method of dipping the core into the coating layer forming solution, a spray method of spraying the coating layer forming solution onto the surface of the core, a fluid-bed method of spraying the coating layer forming solution to the core that is in a state of being floated by the flowing air, and a kneader coating method of mixing the core of the carrier with the coating layer forming solution in the kneader coater and removing a solvent.

The mixing ratio (mass ratio) of the toner to the carrier in the two-component developer (toner:carrier) is preferably from 1:100 to 30:100, and more preferably from 3:100 to 20:100.

EXAMPLES

The present disclosure will now be further specifically described in detail with reference to Examples and Comparative Examples but is not limited thereto at all.

Preparation of Crystalline Resin (A)

Into a three-neck flask, 100 parts by mass of dimethyl sebacate, 67.8 parts by mass of hexanediol, and 0.10 parts by mass of dibutyltin oxide are put. The mixture is reacted at 185° C. for 5 hours under nitrogen atmosphere while water generated in the reaction is removed to the outside. Then, the temperature is increased up to 220° C. while the pressure is gradually reduced, and the resulting product is further reacted for 6 hours and then cooled. Through this process, a crystalline resin (A) having a weight average molecular weight of 33,700 is prepared.

Preparation of Amorphous Resin

Preparation of Amorphous Resin (1)

Into a three-neck flask, 61 parts by mass of dimethyl terephthalate, 75 parts by mass of dimethyl fumarate, 34 parts by mass of dodecenylsuccinic anhydride, 16 parts by mass of trimellitic acid, 137 parts by mass of ethylene oxide adducts of bisphenol A, 191 parts by mass of propylene oxide adducts of bisphenol A, and 0.3 parts by mass of dibutyltin oxide are put. The mixture is reacted at 180° C. for 3 hours under nitrogen atmosphere while water generated in the reaction is removed to the outside. Then, the temperature is increased up to 280° C. while the pressure is gradually reduced, and the resulting product is reacted for 2 hours and then cooled. Through this process, an amorphous polyester resin (1) having a weight average molecular weight of 19,000 is produced.

Preparation of Amorphous Resin (2)

The amounts of the dimethyl terephthalate, dimethyl fumarate, dodecenylsuccinic anhydride, and trimellitic acid are changed to 60 parts by mass, 74 parts by mass, 30 parts by mass, and 22 parts by mass, respectively; except for that, an amorphous resin (2) is produced as in the preparation of the amorphous resin (1). The weight average molecular weight of the amorphous resin (2) is 19,500.

Preparation of Amorphous Resin (3)

The amounts of the dimethyl terephthalate, dimethyl fumarate, dodecenylsuccinic anhydride, and trimellitic acid are changed to 60 parts by mass, 70 parts by mass, 29 parts by mass, and 29 parts by mass, respectively; except for that, an amorphous resin (3) is produced as in the preparation of the amorphous resin (1). The weight average molecular weight of the amorphous resin (3) is 18,200.

Preparation of Amorphous Resin (4)

The amounts of the dimethyl terephthalate, dimethyl fumarate, dodecenylsuccinic anhydride, and trimellitic acid are changed to 55 parts by mass, 64 parts by mass, 27 parts by mass, and 46 parts by mass, respectively; except for that, an amorphous resin (4) is produced as in the preparation of the amorphous resin (1). The weight average molecular weight of the amorphous resin (4) is 17,200.

Preparation of Toner

Preparation of Toner Particles (1)

Into a HENSCHEL MIXER (manufactured by NIPPON COKE & ENGINEERING CO., LTD.), 79 parts by mass of the amorphous polyester resin (1), 7 parts by mass of a colorant (C.I. Pigment Blue 15:1), 5 parts by mass of a release agent (paraffin wax manufactured by NIPPON SEIRO CO., LTD., melting temperature of 73° C.), and 8 parts by mass of the crystalline resin (A) (melting point: 71° C.) are put. The mixture is stirred and mixed at a rotational speed of 15 m/s for 5 minutes, and the resulting mixture is melt-kneaded with an extruder-type continuous kneader.

In the extruder-type continuous kneader, the temperature is 160° C. on the supply side and 130° C. on the discharge side, the temperature of a cooling roller is 40° C. on the supply side and 25° C. on the discharge side. The temperature of a cooling belt is adjusted to be 10° C.

The melt-kneaded product is cooled, then roughly pulverized with a hammer mill, and subsequently finely pulverized with a jet pulverizer (manufactured by Nippon Pneumatic Mfg. Co., Ltd.) to 6.5 μm. The resulting product is classified with an elbow-jet classifier (type: EJ-LABO, manufactured by Nittetsu Mining Co., Ltd.) to yield toner particles (1) having a volume average particle size of 6.9 μm.

The toner particles (1) have an SF1 of 145 and a toluene-insoluble content of 25 mass %.

Preparation of Toner Particles (2)

Except that the amorphous resin (2) is used in place of the amorphous resin (1), toner particles (2) having a volume average particle size of 6.8 μm are produced as in the preparation of the toner particles (1).

The toner particles (2) have an SF1 of 147 and a toluene-insoluble content of 29 mass %.

Preparation of Toner Particles (3)

Except that the amorphous resin (3) is used in place of the amorphous resin (1), toner particles (3) having a volume average particle size of 7.0 μm are produced as in the preparation of the toner particles (1).

The toner particles (3) have an SF1 of 149 and a toluene-insoluble content of 35 mass %.

Preparation of Toner Particles (4)

Except that the amorphous resin (4) is used in place of the amorphous resin (1), toner particles (4) having a volume average particle size of 7.3 μm are produced as in the preparation of the toner particles (1).

The toner particles (4) have an SF1 of 151 and a toluene-insoluble content of 40 mass %.

Preparation of Toner Particles (5)

Except that a ceresin wax (melting temperature: 92° C.) is used in place of the paraffin wax used as the binder resin in the preparation of the toner particles (1), toner particles (5) having a volume average particle size of 6.8 μm are produced as in the preparation of the toner particles (1).

The toner particles (5) have an SF1 of 148 and a toluene-insoluble content of 33 mass %.

Preparation of Toner Particles (C1)

Except that the paraffin wax used as the binder resin in the preparation of the toner particles (1) is changed to another paraffin wax (POLYWAX 725 manufactured by BAKER PETROLITE, melting temperature: 105° C.), toner particles (C1) having a volume average particle size of 7.0 μm are produced as in the preparation of the toner particles (1).

The toner particles (C1) have an SF1 of 146 and a toluene-insoluble content of 45 mass %.

Preparation of Toners and Developers

With 100 parts by mass of the individual toner particles, 1.2 parts by mass of an external additive that is a commercially available fumed silica RX50 (manufactured by NIPPON AEROSIL CO., LTD.) is mixed using a HENSHEL MIXER (manufactured by MITSUI MIIKE MACHINERY Co., Ltd.) at a rotational speed of 30 m/s for 5 minutes, thereby obtaining toners (1) to (5) and (C1), respectively.

With 100 parts by mass of a carrier, 8 parts by mass of the individual toners are separately mixed to produce developers (1) to (5) and (C1), respectively.

In order to produce the carrier, 14 parts by mass of toluene and 2 parts by mass of a styrene-methyl methacrylate copolymer (component ratio: styrene/methyl methacrylate=90/10, weight average molecular weight Mw: 80,000) are stirred for 10 minutes with a stirrer to prepare a coating liquid in which these materials have been dispersed. The coating liquid and 100 parts by mass of ferrite particles (volume average particle size: 50 μm) are put into a vacuum degassing kneader (manufactured by INOUE MFG., INC.) and stirred at 60° C. for 30 minutes. Then, the pressure is reduced for degassing under heating to dry the resulting product, and the dried product is filtered with a 105-μm sieve to yield the carrier.

Examples A1 to A5

An image forming apparatus (trade name: DOCUCOLOR 1450GA, manufactured by Fuji Xerox Co., Ltd.) is modified into an image forming apparatus that includes a fixing device having a similar structure to the fixing device illustrated in FIG. 2 (also referred to as "fixing device A"), a first charger, and a second charger.

Specifically, the image forming apparatus is modified so as to have the first charger and second charger disposed in the vicinity of the nipping region, which is formed between the heating roller and the pressure roller, and downstream of the nipping region in the transport direction of a recording medium. In addition, a filter attached to an exhaust outlet of the image forming apparatus is removed.

The specific positions of the first charger and second charger in the modified image forming apparatus are as follows.

The minimum distance from the downstream end of the nipping region in the transport direction to the first charger is 30 mm, and the minimum distance from the downstream end of the nipping region in the transport direction to the second charger is 30 mm.

The heating roller has an elastic layer of which the thickness is 5.0% of the diameter. The fixing temperature of the heating roller is 160° C.

Each of the first charger and second charger is a single long corona discharge device (modified product of a corona discharge device manufactured by Keyence Corporation), and a charging condition is an applied voltage of ±5 kV.

The developers shown in Table 1 are individually put into the developing device of the image forming apparatus.

Examples B1 to B5

An image forming apparatus (trade name: DOCUCOLOR 1450GA, manufactured by Fuji Xerox Co., Ltd.) is modified into an image forming apparatus that includes a fixing device having a similar structure to the fixing device illustrated in FIG. 3 (also referred to as "fixing device B"), a first charger, a second charger, and a straightening plate.

Specifically, the image forming apparatus is modified so as to have the first charger and second charger that are disposed in the vicinity of the nipping region, which is formed between the heating roller and the pressure roller, and downstream of the nipping region in the transport direction of a recording medium and a straightening plate that has a cross-sectional shape bent at the center and that is disposed downstream of the first charger in the transport direction. In addition, a filter attached to an exhaust outlet of the image forming apparatus is removed.

The specific positions of the first charger and second charger in the modified image forming apparatus are as follows.

The minimum distance from the downstream end of the nipping region in the transport direction to the first charger is 30 mm, and the minimum distance from the downstream end of the nipping region in the transport direction to the second charger is 30 mm.

The heating roller has an elastic layer of which the thickness is 4.0% of the diameter. The fixing temperature of the heating roller is 170° C., and the preset surface temperature of the external heating roller is 180° C.

Each of the first charger and second charger is a single long corona discharge device (modified product of a corona discharge device manufactured by Keyence Corporation), and a charging condition is an applied voltage of ±5 kV.

The developers shown in Table 1 are individually put into the developing device of the image forming apparatus.

Examples C1 to C5

An image forming apparatus (trade name: DOCUCOLOR 1450GA, manufactured by Fuji Xerox Co., Ltd.) is modified into an image forming apparatus that includes a fixing device having a similar structure to the fixing device illustrated in FIG. 3 (also referred to as "fixing device B'"), a first charger, and a second charger.

Specifically, the image forming apparatus is modified so as to exclude the straightening plate from the structure of the image forming apparatus of Examples B1 to B5. In addition, a filter attached to an exhaust outlet of the image forming apparatus is removed.

The fixing temperature of the heating roller is 170° C., and the preset surface temperature of the external heating roller is 180° C.

The developers shown in Table 1 are individually put into the developing device of the image forming apparatus.

Comparative Examples 1 and 2 and Reference Example

The first charger and the second charger are removed from the image forming apparatus of Example A1 to prepare an image forming apparatus of Comparative Example 1.

The first charger, the second charger, and the straightening plate are removed from the image forming apparatus of Example B1 to prepare an image forming apparatus of Comparative Example 2.

The first charger and the second charger are removed from the image forming apparatus of Example A1, and a developer containing the toner particles (C1) is put into the developing device, thereby preparing an image forming apparatus of Reference Example. The fixing temperature of the heating roller is as shown in Table 1.

Evaluations

Evaluation of Fixability at Low Temperature

A patch of an unfixed image which has a size of 4 cm×5 cm and in which the toner is to be used in an amount of 4.0 g/m$^2$ is formed on J paper (A4 size). This patch is printed at a fixed processing speed of 140 mm/s, and the printed image is fixed with fixing temperature being changed from 80° C. to 180° C. by 5° C. The lowest fixing temperature at which offset does not occur (lowest fixing temperature) is determined and evaluated on the basis of the following criteria.

The evaluation criteria are as follows.

A: Lowest fixing temperature of less than 120° C.

B: Lowest fixing temperature of 120° C. or more and less than 130° C.

C: Lowest fixing temperature of 130° C. or more and less than 140° C.

D: Lowest fixing temperature of 140° C. or more

Evaluation of UFPs

An image having an image density of 100% is continuously formed on both sides of 1000 sheets of A3-size paper at a temperature of 22° C. and relative humidity (RH) of 55%. The particle emission rate ($PER_{10\ PW}$) of the UFPs discharged from the image forming apparatus during the formation of the image is measured at Test Laboratory of Fuji Xerox Co., Ltd. in accordance with RAL UZ-171.

The value of the measured particle emission rate [unit (number of particles/10 min)] is evaluated and graded from G1 to G3. The particle emission rates in Comparative Examples in which the fixing device without a collection member is used are graded G3 and serve as the standard to perform relative evaluation. The particle emission rate is smallest in G1, which means that the amount of the UFPs is small.

TABLE 1

| | Developer | | Fixing device | | | | | | Evaluatioons | |
|---|---|---|---|---|---|---|---|---|---|---|
| | Type of toner particles No. | Melting temperature of release agent T2 [° C.] | Type | Fixing temperature of heating roller T1 [° C.] | First charger | Second charger | Straightening plate | T1-T2 [° C.] | Fixability at low temperature | Amount of discharge UFPs |
| Example A1 | (1) | 73 | A | 160 | Corona discharge | Corona discharge | None | 87 | A | G2 |
| Example A2 | (2) | 73 | A | 160 | Corona discharge | Corona discharge | None | 87 | A | G2 |
| Example A3 | (3) | 73 | A | 160 | Corona discharge | Corona discharge | None | 87 | A | G2 |
| Example A4 | (4) | 73 | A | 160 | Corona discharge | Corona discharge | None | 87 | A | G2 |
| Example A5 | (5) | 92 | A | 160 | Corona discharge | Corona discharge | None | 68 | B | G1 |
| Example B1 | (1) | 73 | B | 170 | Corona discharge | Corona discharge | Exist | 97 | A | G1 |
| Example B2 | (2) | 73 | B | 170 | Corona discharge | Corona discharge | Exist | 97 | A | G1 |
| Example B3 | (3) | 73 | B | 170 | Corona discharge | Corona discharge | Exist | 97 | A | G1 |
| Example B4 | (4) | 73 | B | 170 | Corona discharge | Corona discharge | Exist | 97 | A | G1 |
| Example B5 | (5) | 92 | B | 170 | Corona discharge | Corona discharge | Exist | 78 | B | G1 |
| Example C1 | (1) | 73 | B' | 170 | Corona discharge | Corona discharge | None | 97 | A | G2 |
| Example C2 | (2) | 73 | B' | 170 | Corona discharge | Corona discharge | None | 97 | A | G2 |
| Example C3 | (3) | 73 | B' | 170 | Corona discharge | Corona discharge | None | 97 | A | G2 |
| Example C4 | (4) | 73 | B' | 170 | Corona discharge | Corona discharge | None | 97 | A | G2 |
| Example C5 | (5) | 92 | B' | 170 | Corona discharge | Corona discharge | None | 78 | B | G2 |
| Comparative Example 1 | (1) | 73 | A | 160 | — | — | — | 87 | A | G3 |
| Comparative Example 2 | (1) | 73 | B | 170 | — | — | — | 97 | A | G3 |
| Reference Example | (C1) | 105 | A | 200 | — | — | — | 95 | D | G1 |

From the results shown in the table, the amount of the discharged UFPs derived from the release agent used in the toner is reduced more in Examples than in Comparative Examples.

Since the melting temperature of the release agent used in the toner is greater than 100° C. in Reference Example, the amount of discharged UFPs derived from the release agent used in the toner is small.

Since the lowest fixing temperature is higher in Reference Example than in Examples and Comparative Examples, the fixability at low temperature is poor in Reference Example.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit that charges a surface of the image holding member;

an electrostatic latent image forming unit that forms an electrostatic latent image on the charged surface of the image holding member;

a developing unit that includes a developer containing toner particles containing a release agent having a melting temperature ranging from 60° C. to 100° C. and that develops the electrostatic latent image on the surface of the image holding member with the developer to form a toner image;

a transferring unit that transfers the toner image to a first side of a recording medium;

a fixing unit that includes two members of which outer surfaces are in contact with each other to form a nipping region and that allows the recording medium having the transferred toner image to pass through the nipping region to fix the toner image to the first side of the recording medium;

a first charging unit that is disposed in the vicinity of the nipping region and downstream of the nipping region in the transport direction of the recording medium so as to face the first side of the recording medium and that charges particles; and a second charging unit that charges a second side of the recording medium to the opposite polarity to the charged particles after the recording medium passes through the nipping region.

2. The image forming apparatus according to claim 1, wherein the melting temperature of the release agent used in the toner particles ranges from 60° C. to 90° C.

3. The image forming apparatus according to claim 1, wherein the release agent used in the toner particles is a paraffin wax.

4. The image forming apparatus according to claim 1, wherein the toner particles contain a crystalline resin.

5. The image forming apparatus according to claim 4, wherein the amount of the crystalline resin is in the range of 3 mass % to 20 mass % relative to the mass of the toner particles.

6. The image forming apparatus according to claim 4, wherein the amount of the crystalline resin is in the range of 5 mass % to 15 mass % relative to the mass of the toner particles.

7. The image forming apparatus according to claim 1, wherein the toner particles have a toluene-insoluble content ranging from 25 mass % to 40 mass %.

8. The image forming apparatus according to claim 1, wherein the toner particles have a shape factor SF1 of 140 or more.

9. The image forming apparatus according to claim 1, wherein the two members are paired rollers.

10. The image forming apparatus according to claim 1, wherein the fixing unit includes an internal heating unit that heats any one of the two members from an inside.

11. The image forming apparatus according to claim 10, wherein any one of the two members is a roller having an elastic layer having a thickness of from 1.0% to 10.0% of a diameter.

12. The image forming apparatus according to claim 10, wherein any one of the two members has a fixing temperature ranging from 100° C. to 200° C.

13. The image forming apparatus according to claim 12, wherein the fixing temperature is in the range of 120° C. to 200° C.

14. The image forming apparatus according to claim 1, wherein the fixing unit includes an external heating unit that heats any one of the two members from an outside.

15. The image forming apparatus according to claim 1, wherein the fixing unit includes an internal heating unit that heats any one of the two members from an inside and an external heating unit that heats any one of the two members from an outside.

16. The image forming apparatus according to claim 1, wherein between a fixing temperature T1 of any one of the two members and a melting temperature T2 of the release agent used in the toner particles, a difference (T1−T2) is in the range of 30° C. to 140° C.

17. The image forming apparatus according to claim 1, further comprising a straightening plate that generates an airstream that flows from the downstream end of the nipping region in the transport direction of the recording medium to the first charging unit.

18. The image forming apparatus according to claim 1, wherein the second charging unit is disposed in the vicinity of the nipping region and downstream of the nipping region in the transport direction of the recording medium.

* * * * *